United States Patent [19]

Koble, Jr.

[11] Patent Number: 4,590,960

[45] Date of Patent: May 27, 1986

[54] HOSE CONNECTOR ADAPTER APPARATUS FOR EVAPORATIVE COOLER FLOAT VALVE

[76] Inventor: Robert L. Koble, Jr., 521 W. Lynwood, Phoenix, Ariz. 85003

[21] Appl. No.: 689,317

[22] Filed: Jan. 7, 1985

[51] Int. Cl.[4] ..... F16K 43/00; F16K 31/18; F16K 33/00

[52] U.S. Cl. ..... 137/315; 137/434; 137/443; 251/144; 251/148; 285/39; 285/354

[58] Field of Search ..... 137/315, 434, 442, 443; 251/143, 144, 148; 285/39, 354

[56] References Cited

U.S. PATENT DOCUMENTS

| | | | |
|---|---|---|---|
| 1,096,237 | 5/1914 | Gehrke | 137/442 |
| 1,383,008 | 6/1921 | Myers | 285/354 |
| 1,843,394 | 2/1932 | Lange | 285/354 |
| 2,569,333 | 9/1951 | Peterson | 285/354 |
| 3,615,109 | 10/1971 | Brinda et al. | 285/354 |
| 3,874,714 | 4/1975 | Bebinger | 285/354 |
| 4,018,459 | 4/1977 | Mominee et al. | 285/39 |
| 4,030,778 | 6/1977 | Kaut, Jr. | 285/354 |

*Primary Examiner*—G. L. Walton

*Attorney, Agent, or Firm*—H. Gordon Shields

[57] ABSTRACT

Hose connector adapter apparatus for an evaporative cooler float valve includes an integral ferrule for sealing the float valve to the adapter and an internal hexagonally configured passageway through which the water flows and which passageway receives a hex wrench or the like for securing the adapter to the float valve when there is insufficient external clearance for manually securing the adapter to the float valve. The adapter apparatus is able to be secured to evaporative cooler float in virtually any location on a cooler housing, regardless of the cooler housing configuration either by manually securing the adapter or by using a wrench internally.

4 Claims, 9 Drawing Figures

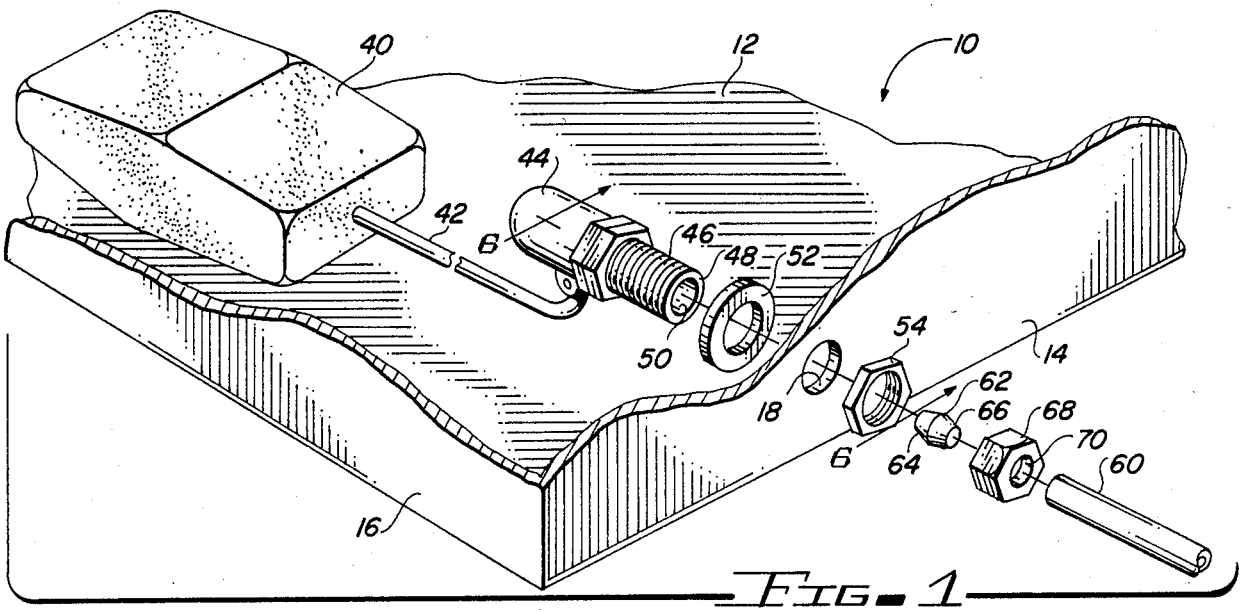
FIG. 1
(PRIOR ART)
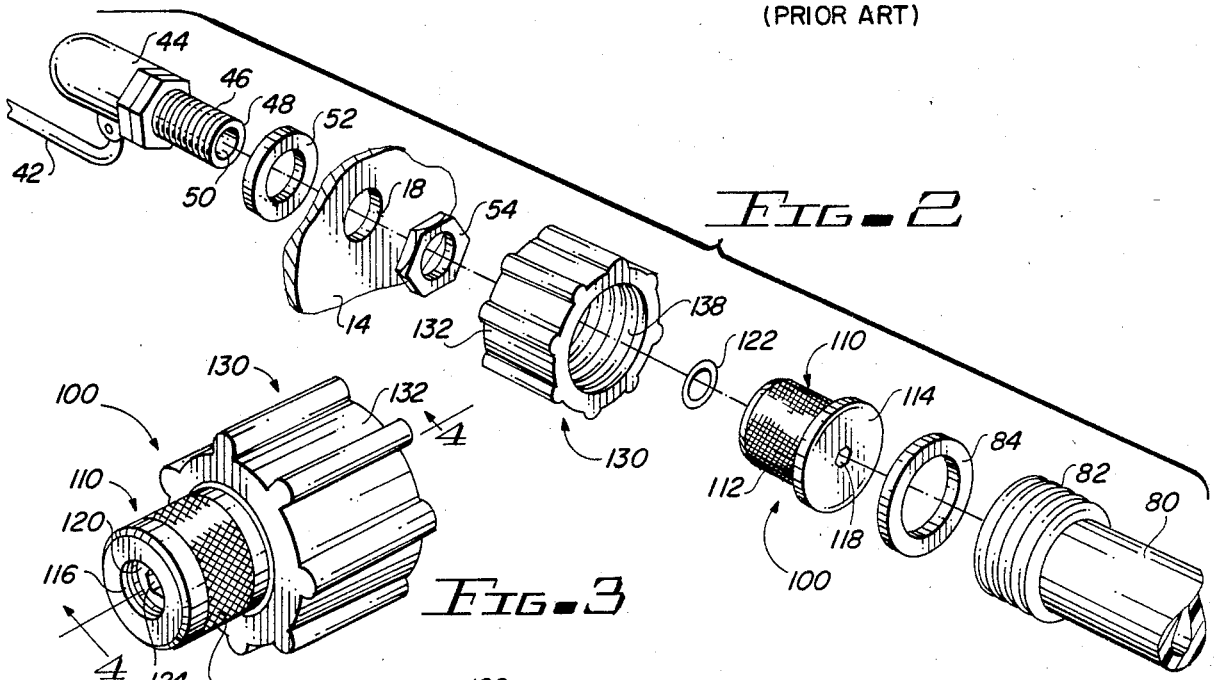
FIG. 2
FIG. 3
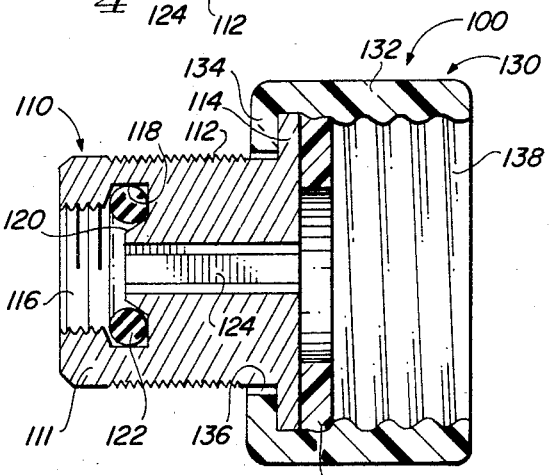
FIG. 4
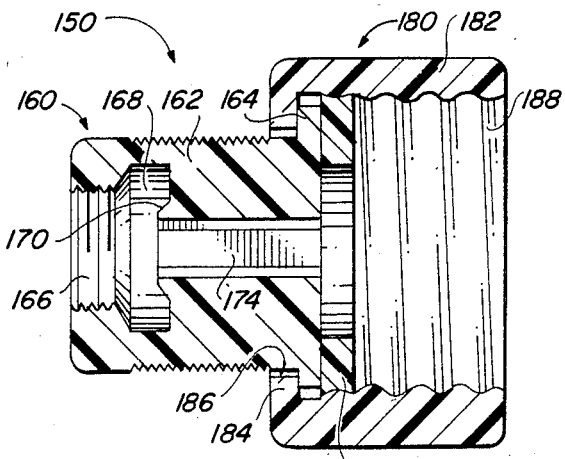
FIG. 5

HOSE CONNECTOR ADAPTER APPARATUS FOR EVAPORATIVE COOLER FLOAT VALVE

BACKGROUND OF THE INVENTION

1. Field of the Invention

This invention relates to connector apparatus for connecting a source of water to an evaporative cooler float valve, and, more particularly, to an adapter for connecting an ordinary garden hose to an evaporative cooler float valve.

2. Description of the Prior Art

Evaporative coolers include a water sump at the bottom of the cooler. The sump comprises a source of water which is circulated and recirculated through pads. Air is forced through the water-soaked pads, and the air is cooled by giving up heat of evaporation to the water in the pads. A pump is disposed in the sump for pumping the water from the sump to the top of the pads, and usually to a series of troughs from which the water flows by gravity downwardly through the pads. The water not evaporated is returned to the sump. Since the water height in the sump is usually kept constant, a source of fresh water is required to replace the water evaporated by the air flow through the pads. In order to keep the water at a constant level, a float valve is used to control the flow of fresh water.

In the prior art, there are generally two kinds of water lines for supplying water to the evaporative coolers. The first type of water line is a copper tubing, which is typically quarter-inch copper tubing, although other sizes of copper tubing are also used. The second type of tubing is plastic tubing, which is comparable in external diameter to the copper tubing.

The exterior threads on the float valve are straight threads, and in order to provide a watertight seal with the two types of tubing, a metal or plastic ferrule is required. The ferrule fits around the outside of the tubing and a compression nut is then used to seal the ferrule, and thus the tubing, against the inside diameter of the valve inlet. The compression nut engages the external threads of the valve inlet, and forces the ferrule to provide a metal to metal seal or a plastic to metal seal.

The tubing is, of course, connected to a water source remote from the cooler. This in turn requires a valve to connect the tubing and the water source. This is typically accomplished by adding a special valve in a water line on the exterior of a building, or dwelling, and usually in conjunction with an outside hose bib. However, the valve is not an ordinary hose bib type valve, but it is usually connected thereto. This generally requires installation by a plumber or a person with more skill than an ordinary householder.

Garden hoses and float valves have threaded connectors that are different in both the diameters and the thread types. Garden hoses have tapered threads, and the float valves have straight threads of much less pitch than garden hoses. The diameter of the garden hose connectors is much greater than the diameter of the float valve connectors.

From the above discussion, it may be understood that the ability to connect an ordinary garden hose to an evaporative cooler float valve would be highly desirable. Garden hoses are easily and inexpensively procured by a householder, and are easily connected to hose bibs. In addition, "Y" hose bib adapters having double bibs are readily available at hardware stores and are easily connected to a single hose bib. The "Y" hose bib adapter thus allows the use of two separate garden hoses from a single hose bib. The use of one of the two valves of such a "Y" adapter allows a garden hose to be dedicated to an evaporative cooler. At the same time, it allows the free use of the second or other valve for connection to a garden hose and to be used as required by the householder, as for example watering the garden, flowers, washing a vehicle, etc. The use of the second hose in no way impairs the dedicated use of the first valve, and its garden hose, exclusively for an evaporative cooler.

The apparatus of the present invention overcomes the problems of the prior art by providing an adapter with an integral ferrule or sealing element for connecting a garden hose to the float valve of an evaporative cooler, and thus eliminates the problems of the prior art associated with the use of tubing, to provide water for an evaporative cooler.

SUMMARY OF THE INVENTION

The invention described and claimed herein comprises an adapter for connecting a garden hose to the float valve of an evaporative cooler, and in which a built-in ferrule or sealing element is used to allow a garden hose having tapered threads to be connected to the straight threads of the evaporative cooler float valve. Two types of tightening means are provided, including manually grasping the apparatus to finger tighten the adapter to the float valve, and having an internal keyway configured to receive a wrench for securing the adapter to the float control valve when the float control valve is in a location that is not readily accessible for finger tightening.

Among the objects of the present invention are the following:

To provide new and useful adapter apparatus for securing a garden hose to an evaporative cooler float valve;

To provide new and useful adapter apparatus for connecting a taper threaded element to a straight threaded element;

To provide new and useful adapter apparatus having an internal sealing element for sealingly connecting a garden hose to a float valve assembly;

To provide new and useful adapter apparatus having an internal keyway for securing the adapter to an exteriorally threaded element; and To provide new and useful hose connector apparatus for connecting a hose to a valve assembly.

BRIEF DESCRIPTION OF THE DRAWING

FIG. 1 is a perspective view, partially exploded, of the prior art in its use environment.

FIG. 2 is an exploded perspective view of the apparatus of the present invention.

FIG. 3 is a perspective view of a portion of the apparatus of the present invention.

FIG. 4 is a view in partial section taken generally along line 4—4 of FIG. 3.

FIG. 5 is a view in partial section of an alternate embodiment of the apparatus of the present invention.

DESCRIPTION OF THE PREFERRED EMBODIMENT

Figure 6:
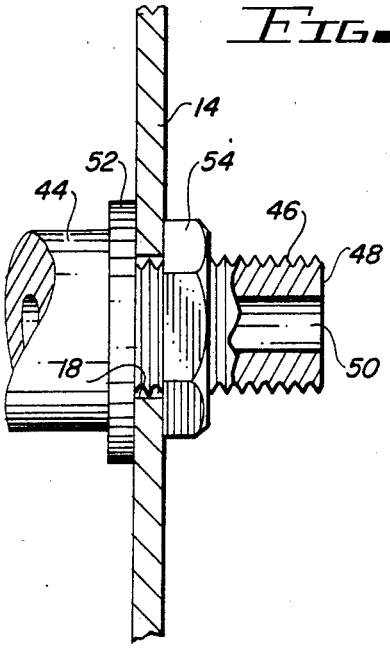
FIG. 6 is an assembled side view taken generally along line 6—6 of FIG. 1.

FIG. 1 is a perspective view of a portion of a housing for an evaporative cooler 10, with only portions of the cooler housing shown, including a bottom wall 12, a side wall 14, and a side wall 16 illustrated. The wall 14 includes an aperture 18 extending through the wall. Within the evaporative cooler 10, and disposed above the bottom 12, is a float 40. The float 40 is secured to a valve 44 by means of an arm 42. The valve 44 controls the inflow of water to the bottom of the evaporative cooler apparatus 10. The float 40 in turn controls the valve 44. That is, when the float 40 moves downwardly with the water level, the valve 44 opens to allow more water to flow into the cooler housing. With the rising water, the float 40 raises and closes the valve 44.

The valve 44 includes a water inlet portion 46. The water inlet portion 46 is threaded externally for connection to an appropriate internally threaded element to secure tubing, such as copper tubing or plastic tubing, to the valve 44 to provide for a source of fresh water to the valve.

At the front of the water inlet 46 is a front face or mouth 48. Extending rearwardly from the face or mouth 48 is a bore 50 through which water flows to the valve.

A flat washer 52 is shown spaced apart from the water inlet portion 46 in FIG. 1, and between the valve inlet portion 46 and the wall 14. In assemblying the valve 44 to the front wall 14 of the cooler 10, the washer 52 is placed over the water inlet portion 46 until it abuts against the front portion of the valve housing. The externally threaded water inlet portion 46 then extends through the aperture 18. A nut 54 threadedly engages the water inlet portion 46 until the nut 54 contacts the wall 14 to secure the valve 44 to the wall 14.

Tubing 60, which may be copper or plastic, as discussed above, extends ultimately into the bore 50 of the water inlet portion 46. The tubing 60 first extends through a compression nut 68 and through a ferrule 62. The compression nut 68 includes a smooth bore 70 which is substantially the same diameter as the outer diameter of the tubing 60. The maximum diameter of the ferrule 62 is greater than the diameter of the bore 70 of the compression nut 68. The ferrule accordingly will not pass through the bore 70.

The ferrule 62 includes two tapered portions or surfaces, including a front tapered surface 64 and a rear tapered surface 66. The tapered surfaces 64 and 66 taper outwardly from a maximum diameter of the ferrule, which is at the longitudinal or axial center of the ferrule.

After the ferrule and the nut are secured to the tubing 60, the tubing 60 is inserted into the bore 50 of the water inlet portion 46 of the valve 44. The compression nut 68 threadedly engages the water inlet portion 46, and at the same time the ferrule 62 makes contact with the face or front end 48 at the bore 50 of the water inlet 46 and with the compression nut 68.

The front tapered surface 64 of the ferrule 62 makes contact with the juncture of the front face 48 and the bore 50 of the water inlet 46. The rear tapered surface or portion 66 of the ferrule 62 makes contact with the interior of the compression nut 68. There is a metal to metal seal formed between the ferrule 62 and the water inlet 46 by the force of the compression nut 68 as the engagement between the threads of the compression nut and the water inlet portion 46 increases. At the same time, there is a sealing engagement between the ferrule 62 and the tubing 60. The sealing engagements provide a watertight connection between the tubing 60 and the valve 44. Water for the evaporative cooler apparatus 10 is provided through the tubing 60.

It will be noted that the external threads of the water inlet portion 46 of the valve 44 are straight threads, with an appropriate diameter and pitch adapted to engage the internal threads of the compression nut 68. It is thus necessary to connect the tubing 60 through a special connector, namely a compression nut and ferrule, to provide water to the evaporative cooler 10.

FIG. 2 is an exploded perspective view of a portion of the wall 14 of the cooler apparatus 10 from FIG. 1, and the valve 44, together with its valve arm 42 and its water inlet 46, the washer 52 and the nut 54, all appropriately aligned with the aperture 18 in the wall 14. However, instead of the tubing 60, the ferrule 62 and the compression nut 68, a hose connector apparatus 100 of the present invention is illustrated in exploded perspective view for securing a hose 80 to the valve 44. The connector apparatus 100 is shown spaced apart from the hose 80, which may be a garden hose. The garden hose 80 may be connected to the apparatus 100 to provide a simple and convenient source of water for the evaporative cooler apparatus 10. The garden hose 80 in turn may be connected to any common, outdoor hose bib, without the need for special tubing adapters, connectors, etc. The hose connector apparatus 100 may thus be used to connect an ordinary garden hose to any evaporative cooler float valve.

FIG. 3 is a perspective view of the hose connector 100 as the component parts are assembled together. FIG. 4 is a view in partial section of the hose connector apparatus 100, taken generally along line 4—4 of FIG. 3. For the following discussion of the connector apparatus 100, reference will primarily be made to FIGS. 2, 3, and 4.

The connector apparatus 100 includes two portions, a valve connector portion 110 and a hose connector portion 130. In FIG. 2, the two primary portions 110 and 130, together with additional elements, are shown spaced apart from each other prior to assembly. In FIG. 3, the component parts are assembled, and the assembled elements are shown in partial section in FIG. 4.

The valve connector portion 110 includes a generally cylindrical portion 111 with a knurled outer surface 112 on the cylindrical portion 111. The knurled portion 112 extends forwardly from a radially outwardly extending flange 114.

The interior of the valve connector portion 110 includes an internally threaded bore 116 which is adapted to mate with the external threads of the water inlet portion 46 of the valve 44.

Adjacent to the internally threaded bore 116 is an enlarged diameter bore or groove portion 118 of bore 116. The diameter of the enlarged bore 118 is substantially greater than that of the internally threaded bore 116. Extending coaxially with the internally threaded bore 116 and the enlarged bore portion 118 is a hexagonally configured bore 124. The hexagonal bore 124 extends forwardly from the radially outwardly extending flange 114 to the enlarged diameter bore portion 118.

A ferrule portion 120 is disposed at the mouth of the hexagonal bore 124 and within the enlarged bore portion 118. The ferrule portion 120 defines a rearwardly and outwardly tapering portion, the taper of which is similar to that of a truncated cone.

At the juncture of the internally threaded portion 116 and the enlarged diameter bore portion 118, and disposed about the ferrule 120, is an O-ring 122. If desired, the O-ring 122 may be omitted so that the ferrule 120 may make direct sealing engagement with the juncture of the front face or mouth 48 and the interior bore 50 of the water inlet 46. In that case, there is a metal to metal seal effected. If it is desired to use the O-ring 122, then the O-ring 122 makes contact with the front face or mouth 48 of the water inlet portion 46 of the valve 44 to provide a sealing engagement between the valve connector portion 110 and the water inlet portion 46 of the valve 44.

The purpose of the hexagonal bore 124 is to allow the use of a wrench, such as an Allen wrench, to be used to secure the connector apparatus 100 in locations where the access to the valve connector portion 110, particularly its exterior knurled portion 112, is not readily available. This will be discussed in detail below, particularly in conjunction with FIGS. 7, 8, and 9.

The hose connector portion 130 includes a generally cylindrical portion 132 extending rearwardly from a radially inwardly extending flange 134. A relatively short bore or mouth 136 extends through the inwardly extending flange 134. On the interior of the cylindrical portion 132 is an internally threaded bore 138. The diameter of the bore 136 is slightly larger than the external diameter of the cylindrical portion 111 of the valve connector 110. The internal diameter of the threaded bore 138 is slightly greater than the outer diameter of the radially extending flange 114 of the valve connector portion 110.

As shown in FIG. 4, in assembling the two portions 110 and 130 together, the cylindrical portion 111 of the valve connector 110 extends through the bore 138 of the hose connector portion 130, and the outwardly extending flange 114 abuts the inwardly extending flange 134. The cylindrical portion 111 then extends through the bore 136.

The threaded bore 138 receives a flat hose washer 84. The washer 84 is disposed against the face of the radially outwardly extending flange 114. The purpose of the washer 84 is to provide a sealing engagement between the hose 80 and the connector apparatus 100.

The hose 80 includes an externally threaded fitting 82. The threaded portion 82 of the hose 80 extends into the threaded portion 138 of the hose connector 130. There is thus a watertight connection provided between the hose 80 and the connector 100, and in turn a watertight connection between the connector 100 and the valve 44.

It will be noted that two threaded connections are required for securing the hose 80 to the valve 44 through the apparatus 100. The first threaded engagement is the connection of the externally threaded portion 46 of the valve 44 to the valve connector portion 110. The second threaded connection is the connection between the hose 80 and the hose connector portion 100.

In operation, the connector apparatus 100 is first assembled as shown in FIG. 4, with the valve connector portion 110 extending through the hose connector portion 130. The valve connector then is connected to the water inlet portion 46 by the internal threads 116 of the valve connector 110 receiving the external threads of the water inlet 46. As indicated above, the O-ring 122 may be disposed within the enlarged diameter bore portion 118, if desired. If not, then the ferrule 120 is used to make a metal to metal watertight abutting connection with the water inlet 46. The connection may be made either manually by using the knurled exterior portion 112 or mechanically by using the hexagonal bore 124 and an appropriate hexagonal (Allen) wrench.

After the valve connector 110 is secured to the valve 44, the hose 80 is then connected to the hose connector portion 130 by the threaded bore 138 receiving the external threads 82 of the hose 80. The threaded connection is accomplished by rotating the hose connector 130 relative to the hose 80. Thus, the two independent rotational movements of the two portions of the connector apparatus 100 are required for connecting the hose 80 to the cooler float valve 44.

FIG. 5 is a view in partial section of an alternate embodiment of the connector apparatus 100 of FIGS. 2, 3, and 4. The new embodiment comprises connector apparatus 150, which is substantially identical to the apparatus 100 in its essential components. However, the connector apparatus 100 of FIG. 4 is shown by its cross-hatching as including a metal valve connector portion 110 and plastic hose connector portion 100. Moreover, the metal valve connector portion 110 is shown with an O-ring 122 for making an abutting sealing engagement with the valve 44. The connector apparatus 150 is illustrated by its hatching as including a plastic valve connector portion 160 and a plastic hose connector portion 180. In addition, the valve connector portion 160 is shown without an O-ring, and thus an abutting sealing engagement between the valve connector portion 160 and the valve 44 is accomplished by direct contact of a ferrule 170. The direct connection by the built-in ferrule 120 in the connector apparatus 100 has been discussed above.

The connector apparatus 150 includes the same basic elements or portions as does the connector apparatus 100. The connector apparatus 150 includes a valve connector portion 160 and a hose connector portion 180. The hose connector portion 160 includes a cylindrical portion 162 extending forwardly from a radially outwardly extending flange 164. The outer periphery of the cylindrical portion 162 is preferably knurled to facilitate the connection of the valve connector portion 160 with the externally threaded water inlet portion 46 of the valve 44.

Within the valve connector portion 160 are three bores, including an internally threaded bore 166, an enlarged diameter bore 168, and a hexagonal bore 174. The three bores are coaxially aligned with each other. At the juncture of the enlarged diameter bore 168 and the hexagonal bore 174 is an integral ferrule 170. The ferrule 170 comprises a conically tapered portion which extends outwardly from the mouth of the hexagonal bore 174 rearwardly to the enlarged diameter bore 168. If desired, an O-ring, such as the O-ring 122, may be disposed within the enlarged diameter bore 168 to provide a sealing engagement with the valve 44. If the O-ring is omitted, as is shown in FIG. 5, then the ferrule 170 provides the direct sealing engagement with the valve 44. This sealing engagement is as discussed above with respect to the ferrule 170, with the ferrule 170 contacting the juncture of the front face 48 and the bore 50 of the water inlet portion 46. This engagement is, of course, accomplished by rotation of the valve connector portion 160 to provide the threaded engagement between the internally threaded bore 166 and the externally threaded water inlet portion 46 of the valve 44.

The rotation of the valve connector portion 160 may be accomplished either by the direct rotation of the cylindrical portion 162, as by a user's fingers, if possible, or, in the alternative, by means of a hexagonal (Allen) wrench extending into the hexagonal bore 174.

The hose connector portion 180 includes a generally cylindrical portion 182 extending rearwardly from a radially inwardly extending flange 184. The inner periphery of the radially inwardly extending flange 184 comprises a relatively short bore or mouth opening 186. The diameter of the bore or mouth 186 is slightly greater than the diameter of the cylindrical portion 162 of the valve connector portion 160, but is less than the outer diameter of the radially outwardly extending flange 164.

Within the cylindrical portion 182 is an internally threaded bore 188. The tapered internal threads of the bore 188 are configured to mate with the external tapered threads 82 of the hose 80. The diameter of the threaded bore 188 is, of course, greater than the diameter of the outwardly extending flange 164.

For assembling the two portions 160 and 180 together, the cylindrical portion 162 extends through the threaded bore 188, until the radially outwardly extending flange 164 contacts the radially inwardly extending flange 184. The hose washer 84 is then disposed against the rear face of the flange 164 of the valve connector 160.

After securing the valve connector portion 160 to the externally threaded portion 46 of the valve 44, the hose 80 may be connected to the hose connector portion 180. Again, two separate rotary movements are required for connecting the connector apparatus 150 to both the valve 44 and the hose 80. Also, it will be noted that the rotary movements are in the opposite direction. That is, for utilizing normal right-handed threads, the valve connector portion 160 will be rotated clockwise, and the hose connector portion 180 will be rotated counterclockwise.

FIG. 6 is a side view in partial section of the wall 14 of the evaporative cooler apparatus 10. The valve 44 is shown assembled to the wall 14 by means of the flat washer 52 disposed between the valve 44 and the wall 14. The water inlet portion 46 of the valve 44 extends through the aperture 18 in the wall 14. A nut 54 threadedly engages the water inlet portion 46 and is disposed against the wall 14 to secure the valve 44 to the wall 14. The water inlet portion 46 of the valve 44 extends beyond the nut 54, and is thus ready to receive, or to be connected to, either of the connectors 100 or 150. As indicated above, connection may be accomplished by the engagement of the internally threaded bore portion of the valve connector portions of the respective connectors, either with or without an O-ring. If an O-ring is used, then a sealing engagement between a valve connector and the valve 44 is accomplished by the O-ring contacting the outer or front face 48. If the O-ring is omitted, then a sealing engagement is accomplished by means of the built-in ferrule which contacts the juncture of the outer face 48 and the bore 50 to provide the required sealing connection.

Figure 7:
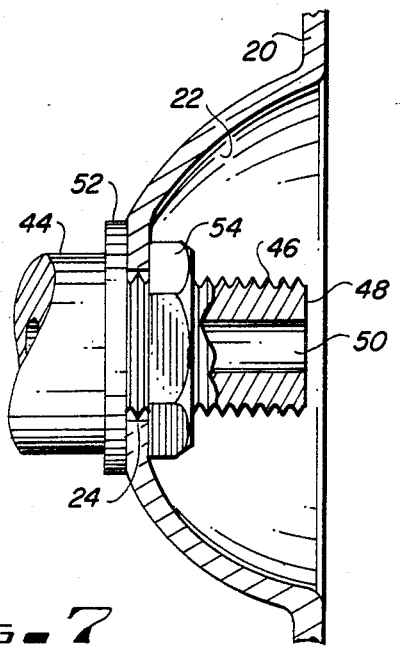
FIG. 7 is a side view of an alternate embodiment of the apparatus of FIG. 6.

FIG. 7 is a view in partial section of an alternate embodiment of an evaporative cooler in which the valve 44 is connected to an indentation 22 in a wall 20 of an evaporative cooler. It will be noted, with respect to FIG. 1 and to FIG. 6, that, if the valve 44 is assembled to the cooler wall 14, a portion of the valve extends outwardly beyond the wall 14. For shipping purposes, this creates problems in that special protection is needed for the water connector portion 46 of the valve 44. This will also mean that the package or crate in which a cooler is shipped must be of a length sufficient to accommodate the outwardly extending portion of the valve. Obviously, this is an undesirable situation. Accordingly, in most shipping situations, the valve 44 is not assembled to the cooler, but rather is simply packaged within the cooler and assembly must then be accomplished after the cooler is uncrated or unpackaged. On the other hand, by providing an indentation or dimple 22 in the cooler wall 20, the valve 44 may be assembled and shipped without the requirement of the extra length of the package or crate and without the extra padding or protection required for the outwardly extending valve portion.

Within the dimple or indentation 22 is an aperture 24. The valve 44 is shown extending through the dimple 24 and secured therein by means of the flat washer 52 and the jamb nut 54. Extending outwardly from the jamb nut 54 is the externally threaded water inlet portion 46. The front face 48 of the water inlet 46 terminates within the dimple 22, and thus does not extend outwardly beyond the wall 20.

For securing either the connector 100 or the connector 150 within the dimple 22 to the valve 44, a hex (Allen) wrench will be required since the size of the dimple or indentation 22 is not sufficient to allow a user to rotate the cylindrical portions 111 or 162 of the valve connector portions 110 or 160, respectively. The securing of either the connector 100 or 150 to the valve 44 must thus be accomplished by extending a hex (Allen) wrench into the hex bore 124 or 174. Obviously, in order to remove the connector from the valve 44, a similar wrench must be used to disengage the internally threaded bore of the valve connector portion from the external threaded portion 46 of the valve 44.

Figure 8:
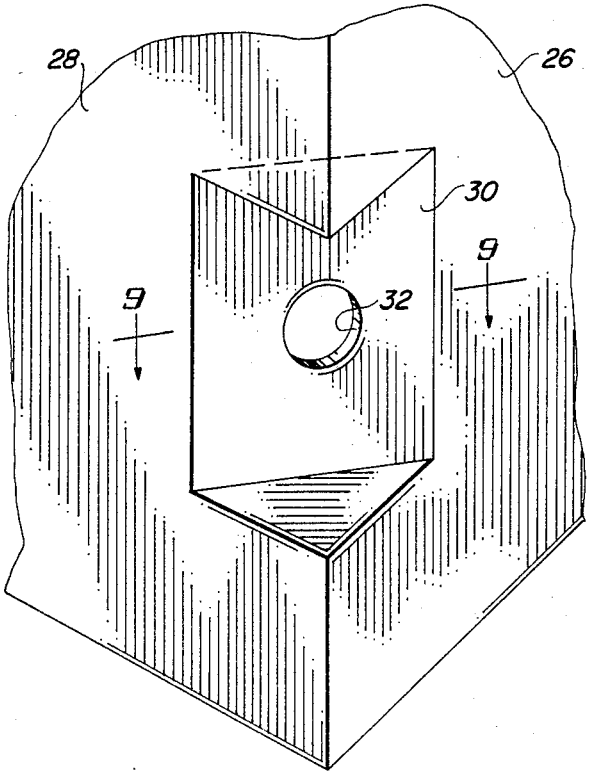
FIG. 8 is a front perspective view of an alternate embodiment of the apparatus of FIGS. 6 and 7.

FIG. 8 is a perspective view of an alternate embodiment of a cooler in which a flat recess 30 is disposed at the juncture of a pair of adjacent walls 26 and 28 of an evaporative cooler. Thus, rather than have a dimple or recess 22 in a cooler side, a flat portion 30 is configured at the juncture of two walls. The flat 30 includes a hole or aperture 32 extending through the flat. The cooler with the flat 30 has the same advantages as does the cooler with the indentation 22, namely the advantage of allowing the cooler to be shipped in the smallest practical package with the float valve assembled.

Figure 9:
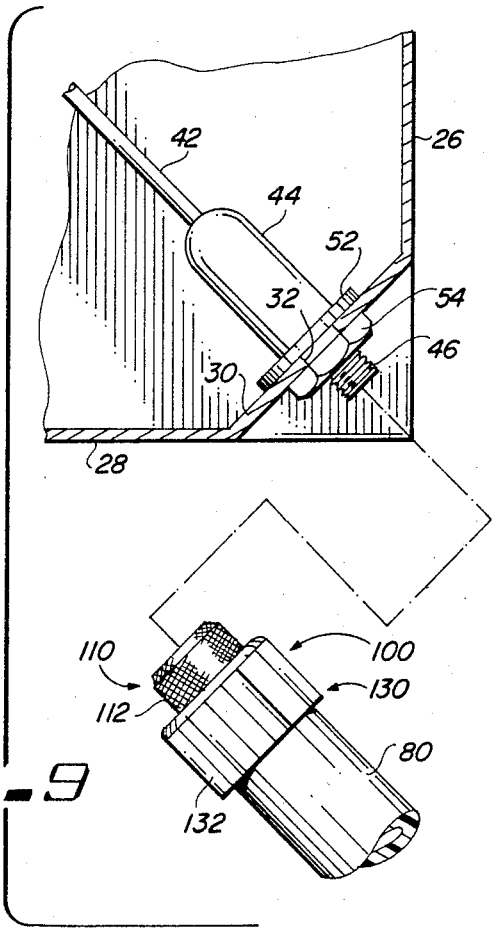
FIG. 9 is a top view of the apparatus of FIG. 8, taken generally along line 9—9 of FIG. 8.

FIG. 9 is a view in partial section taken generally along line 9—9, showing a valve 44 secured to the flat wall portion 30 and through the aperture 32. The connector 100 is shown connected to a hose 80 and spaced slightly apart from the valve 44, for convenience of illustration.

The valve 44 is shown in FIG. 9 secured to the wall flat 30 and is secured therein by the jamb nut 54. The flat washer 52 extends between the valve 44 and the wall 30, and the jamb nut 54 is disposed on the opposite side of the wall 30, and about the water inlet portion 46. For securing the connector 100 to the valve 44, there may be sufficient space on the flat 30, between the upper and lower portions thereof, to manually rotate the cylindrical portion 111 by the externally knurled portion 112 so as to engage the exterior threads of the water inlet 46 by the interior threads of the bore 116. If there is not sufficient space for the manual rotation of the cylindrical portion 111, then an appropriately configured wrench, in the case discussed above, a hexagonally configured Allen wrench, will be inserted through the internally threaded bore 138 of the cylindrical portion 132 of the hose connector portion 130 and into the bore 124 for purposes of rotating the valve connector portion 110. This is accomplished as discussed in detail above. If the O-ring 122 is used, then the O-ring makes a sealing engagement between the valve connector portion 110 and the front face 48 of the valve 44. If the O-ring 122 is not used, then the conically tapered ferrule 120 of the valve connector portion 110 provides a sealing engagement with the juncture of the face 48 and the internal bore 50.

When the valve connector portion 110 is secured to the water inlet portion 46 of the valve 44, the hose connector portion 130 of the connector apparatus 100 is ready to receive, and thus to be secured to, the garden hose 80. The hose washer 84 is inserted into the internally threaded bore 188 and is disposed against the rear face of the valve connector portion 110, which includes the radially outwardly extending flange 114, to provide a sealing engagement with the garden hose 80.

As discussed above, the relative rotation of the two portions of the connector apparatus 100 and the valve 44 and hose 80 is in opposite directions. That is, rotation of the valve connector portion 110 is in one direction to engage its internal threads with the external threads of the valve 44, and the rotation of the hose connector portion 130 is in the opposite direction to engage the threads of the threaded portion 82 of the garden hose 80.

When the connector 100, or the connector 150, has been thus secured to both the float valve and the garden hose, the water source, such as the hose bib, to which the opposite end of the hose 80 is connected (not shown), may be opened to allow water to flow through the hose 80 and through the connector apparatus to the float valve 44. Water flows, of course, through the hexagonal bore in the connector from the hose 80 to the bore 50 of the water inlet portion 46 of the valve 44. The water then flows through the valve 44 in response to movement of the float arm 42 which is in turn controlled by the float 40.

While the bores 124 and 174 of the valve connector portions 110 and 160, respectively, have been discussed as hexagonally configured, it will be understood that any other noncircular or non-cylindrical configuration may be used so long as the bore is configured to receive some type of a wrench which may be used to rotate the valve connector portion to connect the valve connector portion to the float valve. In contemporary usage, the hexagonally configured Allen wrench is the most common type of wrench used. However, a square bore, thus using a square wrench, could also be used, or any other type of noncircular (non-cylindrical) wrench and bore may be used.

In the above discussed embodiments, four bores are discussed. The bore of greatest diameter is the internally threaded bore of the hose connector portion which receives the external threads of a garden hose at one end of the bore and connects to the valve connector at the opposite end of the bore. Communicating with the relatively large diameter internally threaded bore of the hose connector portion is the hexagonal bore in the valve connector portion. In turn, the hexagonal bore of the valve connector portion communicates with both the other two bores, namely the enlarged diameter bore and the internally threaded bore. The diameter of the enlarged diameter bore is greater than the diameter of both the internally threaded bore and the hexagonally configured bore. However, it will be readily understood from FIGS. 4 and 5 that the diameter of the interior threaded bore of the hose connector portion has the greatest diameter of any of the four bores.

The purpose of the enlarged diameter bore portion is two-fold. One purpose is the requirement of the enlarged diameter bore portion in order to machine the ferrule. Secondly, such an enlarged diameter bore portion is required if an O-ring is used as a sealing element, rather than the ferrule. However, if the ferrule is eliminated, and an O-ring is used solely, and without the option of a ferrule, then the enlarged diameter bore portion may be eliminated, and a flat end wall or shoulder may then be used at the juncture of the internally threaded bore and the hexagonally configured bore, with the O-ring disposed against such flat wall or shoulder.

In usage, the plastic connector apparatus 150 would be best adapted, or most easily adapted, to such a flat end wall or shoulder for exclusive use of an O-ring or flat washer as a sealing element. If a ferrule is used, then a metal ferrule 120, made of brass or similar material, of the embodiment of connector apparatus 100, is preferred, since the valve 144 will generally be metal also. However, either metal or plastic may include or may exclude a ferrule, as desired, and either or both may include an O-ring or other appropriate sealing element if desired.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Connector apparatus for connecting a garden hose to a float valve, comprising, in combination:

hose connector means rotatable for connecting to the garden hose, including a first bore internally threaded for connecting to the garden hose and having a first end for receiving the garden hose and a second end remote from the first end, a first flange extending radially inwardly at the second end of the first bore, an opening extending through the radially inwardly extending flange, and a shoulder between the opening and the first bore; and valve connector means rotatable relative to the hose connector means for connecting to the float valve, including a first portion extending through the opening in the hose connector means, a second bore in the first portion internally threaded for connecting to the float valve, a third bore communicating with the second bore through which water flows from the hose to the float valve, a second flange defining a second portion extending radially outwardly from the first portion remote from the second bore and disposed against the first flange of the hose connector means, and a tapered portion comprising a ferrule at the juncture of the second bore and the third bore, said tapered portion extends into the second bore and is concentric therewith in a first abutting sealing engagement with the float valve.

2. The apparatus of claim 1 in which the second bore valve connector means further includes a fourth bore or groove portion at the juncture of the second bore and the third bore having a diameter greater than that of the second bore for receiving a sealing element in a second abutting sealing engagement with the float valve.

3. The apparatus of claim 1 in which the third bore is adapted to receive a wrench for securing the valve connector means to the first valve.

4. The apparatus of claim 1 in which the third bore has an internal configuration other than round for receiving a wrench to rotate the valve connector means relative to the hose connector means.

* * * * *